US005586348A

United States Patent [19]

Toivio et al.

[11] Patent Number: 5,586,348

[45] Date of Patent: *Dec. 24, 1996

[54] AIR MATTRESS AND METHOD FOR ADJUSTING IT

[75] Inventors: Ilkka Toivio; Terttu Toivio, both of Lahti; Kari Olkkonen, Kauttua, all of Finland

[73] Assignee: Ahlstrom Consumer Products Ltd., Finland

[ * ] Notice: The term of this patent shall not extend beyond the expiration date of Pat. No. 4,999,867.

[21] Appl. No.: 9,648

[22] Filed: Jan. 27, 1993

Related U.S. Application Data

[63] Continuation-in-part of Ser. No. 625,940, Dec. 11, 1990, abandoned, which is a continuation-in-part of Ser. No. 209,978, Jun. 22, 1988, Pat. No. 4,999,867.

[30] Foreign Application Priority Data

Jun. 24, 1987 [FI] Finland ..... 872813

[51] Int. Cl.[6] ..... A47C 27/10

[52] U.S. Cl. ..... 5/710; 5/453; 5/713

[58] Field of Search ..... 5/441, 449, 453, 5/455, 456; 428/178, 193, 194

[56] References Cited

U.S. PATENT DOCUMENTS

| | | |
|---|---|---|
| 1,711,255 | 4/1929 | Weinman et al. . |
| 2,751,610 | 6/1956 | Griswold . |
| 3,192,540 | 7/1965 | Swank . |
| 3,736,027 | 5/1973 | Stafford . |
| 3,762,404 | 10/1973 | Sakita . |
| 4,310,936 | 1/1982 | Benjamin . |
| 4,428,087 | 1/1984 | Horn . |
| 4,467,484 | 8/1984 | Nagatake et al. . |

(List continued on next page.)

FOREIGN PATENT DOCUMENTS

| | | |
|---|---|---|
| 0296689 | 12/1988 | European Pat. Off. . |
| 3535374 | 4/1987 | Germany . |
| 372880 | 1/1975 | Sweden . |
| 959103 | 5/1961 | United Kingdom . |
| 1442994 | 7/1976 | United Kingdom . |
| 1498661 | 1/1978 | United Kingdom . |
| 1545806 | 5/1979 | United Kingdom . |
| 2141333 | 12/1984 | United Kingdom . |
| 92/07541 | 5/1992 | WIPO . |

OTHER PUBLICATIONS

"Carital Optima" mattress brochure by Ahlstrom Corporation published in Jun., 1992 (4 pages).

*Primary Examiner*—Michael J. Milano
*Attorney, Agent, or Firm*—Merchant, Gould, Smith, Edell, Welter And Schmidt, P.A.

[57] ABSTRACT

An air mattress includes an underlay (1) and a number of elongate first elements (2), filled with air and fastened to the bottom part of the mattress parallel to each other and transversally against the lengthwise direction of the mattress. The first mattress elements (2) form upward directed arched structures from their cross-section when inflated with air. The mattress also includes a number of elongate air-inflatable resilient second elements (9), in connection with the first mattress elements (2). Each first element (2) is at least partly around each second element (9) outside the first element. Each first mattress element (2) includes at least one first fastening member arranged in the lengthwise direction of the mattress element and a corresponding second fastening member arranged on the underlay (7). The fastening members are removably attached to each other, so each mattress element is unfastened from the underlay and change another. A method for adjusting an air mattress includes a step of partly filling the mattress elements (2; 9) with air. The mattress pressure corresponds to the surrounding pressure when the mattress elements are not subjected to a weight load, but the mattress pressure grows according to the weight load, so that the mattress elements conform to the contours of the weight load, and simultaneously the surface pressure against the weight load is distributed evenly over the whole weight load, such as a human body or part thereof.

26 Claims, 6 Drawing Sheets

U.S. PATENT DOCUMENTS 4,472,472 9/1984 Schultz .
4,637,083 1/1987 Goodwin .
4,651,369 3/1987 Guldager .
4,662,012 5/1987 Torbet .
4,682,378 7/1987 Savenije .
4,686,722 8/1987 Swart .
4,694,520 9/1987 Paul et al. .
4,698,864 10/1987 Graebe .
4,797,962 1/1989 Goode .

AIR MATTRESS AND METHOD FOR ADJUSTING IT

This is a continuation-in-part application of Ser. No. 07/625,940, filed on Dec. 11, 1990, abandoned, which in turn is a continuation-in-part application of Ser. No. 07/209,978, filed on Jun. 22, 1988, patented, U.S. Pat. No. 4,999,867, issued on Mar. 19, 1991.

BACKGROUND OF THE INVENTION

The present invention relates to a mattress, particularly to an air mattress or the like comprising a number of adjacent, elongate bag-like elements which can be filled with gas such as air, or with some other flowing medium, and which elements are arranged transversally with respect to the longitudinal axis of the mattress.

The invention also relates to a method for adjusting the mattress, particularly an air mattress.

A serious problem in modern nursing is to create a bed environment which causes as little trouble and inconvenience to the patient as possible, and where various tasks connected to the patient's care can be carried out, such as cleaning and washing. Particularly patients who are confined to bed for a long time or permanently, and cannot turn or move their limbs themselves, inevitably get bedsores when lying on ordinary beds and mattresses. The bedsores make the regular care of the patient even more difficult, and serve, among others, as entry routes for various infections. Bedsores are created in places where the surface pressure against the skin is continuously higher than 35–50 cm $H_2O$. These patients must therefore be turned, or their position changed, every two or three hours by nurses. However, the moving or turning of for instance multihandicapped patients may in practice be impossible.

In the prior art there are known air mattresses compiled of separate elements, and other corresponding soft beddings, some of these being introduced for instance in the U.S. Pat. No. 3,192,540 and in the GB patent publications 1,545,806 and 2,141,333.

The U.S. Pat. No. 3,192,540 discloses a pneumatic seat cushion composed of adjacent, elongate compartments, which are inflatable with some pressurized medium such as pressure air. The compartments are separate but connected to each other. They are filled with air up to a desired pressure, whereafter the filler pipe is cut off. Now the compartments rest adjacently against a straight board, and are hemispherical in cross-section. This seat cushion structure is not sufficiently resilient and solid in order to effectively conform to the forms of the human body, so that it would provide a firm support at the same time. Moreover, the structure is unstable and does not prevent so-called bottom contacts, i.e. the surface layer is at times pressed against the bottom owing to the weight loaded on the mattress.

The British patent application 2,141,333 introduces an air mattress composed of separate, adjacently installed air sacs which are interconnected by means of air ducts. The sacs are arranged inside a bed frame structure, transversally with respect to the longitudinal direction of the bed. In addition to this, the sacs are divided into five groups, and each of these groups is connected to the air supply device by means of a separate conduit. This type of mattress requires a special frame structure, whereto the air supply device is also connected as an independent unit. A corresponding mattress suggestion is introduced in the British patent publication 1,545,806.

The mattress and bed structures introduced in the above mentioned patent publications GB 1,545,806 and GB 2,141,333 are designed particularly for hospital environments. In these examples, the air mattress and the bed frame form an inseparable entity. They are complex in structure and expensive to manufacture, and consequently by no means suited to be used as regular mattresses in ordinary homes.

SUMMARY OF THE INVENTION

The purpose of the present invention is to realize a mattress, particularly an air mattress, and a method for adjusting it, whereby the aforementioned drawbacks, among others, can be avoided. The air mattress of the present invention is simple in structure and suitable for series production, wherefore the production costs remain moderate. Thus the mattress can be used in many different conditions, both in homes and in hospitals.

The air mattress of the invention is disclosed in the appended patent claims 1–25. The method of the invention for adjusting the air mattress is disclosed in the appended patent claims 26–29.

The mattress of the invention comprises a bottom part, and a plurality of elongate, bag-like first mattress elements; each of the said first mattress elements encloses a first fluid chamber for a flowing medium, and the said first elements are essentially parallel to each other and transverse to the longitudinal axis of said mattress, and the first elements are fixed to the bottom part at least at one fixing joint essentially parallel to the longitudinal direction of the mattress element, so that two mattress elements at the most are formed as an arched structure, which is directed upward from the bottom part and is transverse to the longitudinal direction of the mattress; the fluid chambers of the said mattress elements are inflatable with a flowing medium up to a suitable pressure while using the mattress.

In a preferred embodiment of the mattress of the invention, each first mattress element is fixed to the bottom part of the mattress at two fixing joints essentially parallel to the longitudinal direction of the mattress, the fixing joints being located at the lengthwise sides of the mattress element, the distance of said fixing joints being smaller than the width of the first mattress element, so that the mattress element is formed as an arched structure, resembling for example an upturned U-shape, which is directed upward from the mattress bottom and is transverse to the longitudinal direction of the mattress.

In another preferred embodiment of the mattress of the invention, each first mattress element is fixed to the bottom part of the mattres at one fixing joint essentially parallel to the longitudinal direction of the mattress, said fixing joint being located at the lengthwise sides of the mattress, so that the mattress element is formed as an arched structure where the lengthwise sides of the mattress are interconnected, and which element is directed upward from the mattress bottom and is transverse to the longitudinal direction of the mattress.

In another preferred embodiment of the mattress of the invention, two adjacent first mattress elements are fixed to each other at the first lengthwise sides of the mattress elements and to the bottom part of the mattress at two fixing joints essentially parallel to the longitudinal direction of the mattress elements and located at the second sides of thereof, the mutual distance of said fixing joints being smaller than the width of two first mattress elements, so that two mattress elements are formed as an arched structure which is directed upward from the mattress bottom and is transverse to the longitudinal direction of the mattress.

An advantadge of the invention is that owing to the arched structure of the first mattress elements, the mattress is resilient, and its resilience is easily adjusted. The first fluid chamber of each first mattress element is relatively small in comparison to the volume required by the arched structure, and therefore the elastic properties of the mattress can be remarkably adjusted by slight changes in the fluid supply, and the mattress can be adjusted to an optimal state for the person lying thereon. Moreover, the size and structure of the first mattress elements is such that the pressurized medium cannot escape from the fluid chamber of the mattress element left under the person set on the mattress, to those parts of the fluid chambers of the mattress element which parts are located at his both sides—in which case the mattress element carries the person resting thereon exactly as was desired and predicted. It is pointed out that the arched structural element of the mattress, composed of one or two mattress elements, as such forms an elastic structure, which is manipulated in the desired fashion by adjusting the fluid pressure in the fluid chamber. The use of the arched structure also has an advantageous effect on the thickness of the mattress, which can be chosen to be suitable, so that it can be used in ordinary beds, too.

In a preferred embodiment of the mattress, it comprises a number of elongate and flexible second mattress elements, which are fitted in connection with the first mattress elements, so that outside the first mattress elements, they are at least partly encompassed by the arched structures.

An advantage of the above described embodiment is that the first and second mattress elements together form the structure of the mattress, in which case the adjusting of its properties, particularly that of elastic properties, becomes easier. The second mattress elements are used for example in setting the basic flexibility of the mattress and in preventing so-called bottom contacts, whereas the personal adjusting for each patient is carried out by adjusting the pressures of the first mattress elements. This stucture enables versatile adjustments and also secures that the patient or other person using the mattress always lies on a flexible bedding, even if one of the first mattress elements, for example, should for some reason be exhausted of the fluid. The thickness of the mattress can be chosen to be suitable without sacrificing other properties, so that it can be used in ordinary beds, too.

In another preferred embodiment of the mattress, each first fixing joint of the mattress element is provided with at least one first fastening member arranged in the longitudinal direction of the element, and the fixing joint of the bottom part is provided with a matching second fastening member, which fastening members can be detachably fixed to each other, so that each mattress element can be detached from the bottom part and replaced.

The matching fastening members provided in the mattress element and the bottom part can be realized in many different ways. Advantageously the fastening members are easily interlocked and again unlocked; they are for instance members which can be locked by pressing together, and respectively unlocked by pulling apart. On the other hand, apart from easy fastening and detaching properties, another requirement is that the mattress elements remain reliably in place in the bottom part and cannot come off by themselves. Therefore it is preferable that the mattress elements are fixed to the bottom part in a linear or band-like fashion, either at several successive spots or continuously, which also enlarges the gripping surface.

A particular advantage of the mattress of the said preferred embodiment is, that its elongate bag-like mattress elements are replaceable by new corresponding elements, when for one reason or another the gas or other fluid pumped therein flows out. Moreover, a leeking mattress element is easily replaced even when the patient is lying on the bed, because the fastening members are simple and are easily unlocked and locked respectively. Yet another advantage is that the mattress is simple in structure and economical in production costs, because the employed fastening members are simple pieces, which are easily attached both to the mattress elements and to the bottom part.

In another preferred embodiment of the mattress, the bottom part is essentially a rectangular, plate-like and flexible piece. The bottom part can be formed of one uniform plate, such as plastic film, fabric or other such material. Alternatively the bottom part can be formed of adjacent ribbon-like members spaced apart. The purpose of the bottom part is to serve as a fixing plate for the first mattress elements, so that they maintain the desired shape and are located suitably spaced apart. The fact is that the mattress is used both in ordinary and hospital beds. Thus the bottom does not have to be a stiff support structure for the mattress elements, but it can be a simple, relatively light and flexible, but at the same time strong underlay structure, which keeps well in shape.

When the elements of the mattress of the invention are partly filled with fluid, preferably gas such as air, so that the fluid pressure corresponds to that of the surroundings when the mattress elements are unloaded, but increases in a known fashion according to the weight load of the human body or part thereof directed on the mattress, and in such a fashion that the supporting and resilient top surface of the mattress conforms to the body or part thereof and simultaneously distributes the surface pressure directed against the body or part thereof evenly over the whole body or part thereof.

The surface pressure against the skin of the person lying on the mattress of the present invention remains, on each spot pressed against the bedding, such that the capillary circulation can continue without disturbance. This is of special importance in hospital surroundings. In hospital use, it is not necessary to change the position of the patient for example when the patient sleeps. The mattress is convenient for the patient and does not cause any additional trouble or pain. Normal beds, such as hospital beds, can easily be provided with mattresses according to the present invention whenever necessary.

The adjusting method of the mattress is simple and reliable. The mattress is easy to use, and the price remains economical in industrial production.

BRIEF DESCRIPTION OF THE DRAWINGS

In the following the invention and its further advantages are explained in detail with reference to the appended drawings, where.

DESCRIPTION OF THE PREFERRED EMBODIMENTS

Figure 1:
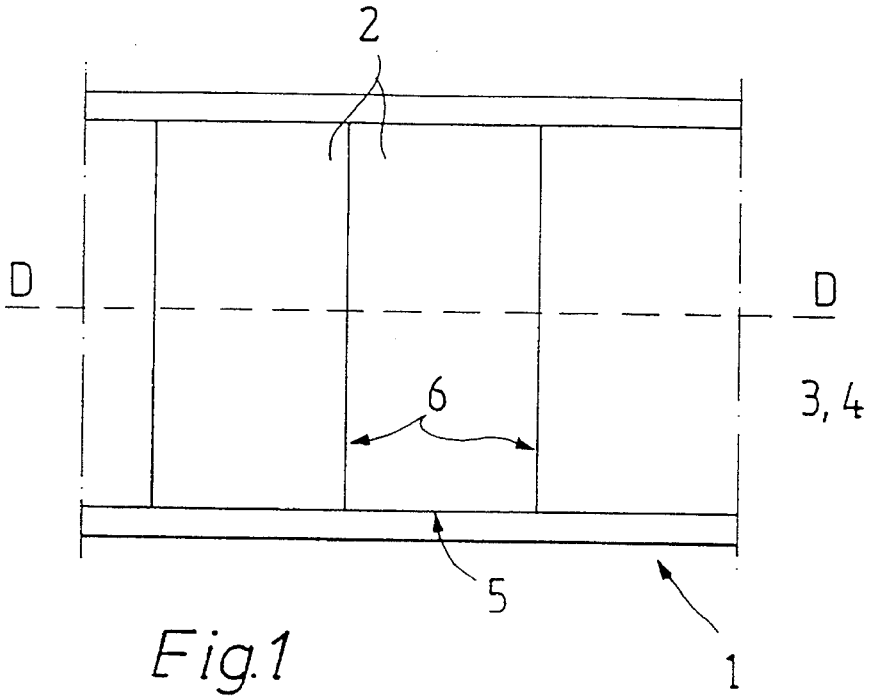
FIG. 1 is a top-view illustration of a structure of a mattress of the present invention as spread out.

The mattress 1 in FIGS. 1, 2A, 3A and 4 comprises a number of adjacent, elongate and bag-like elements 2, which can be inflated with fluid, preferably air or some other gas. The elements 2 are arranged transversally with respect to the longitudinal axis D—D of the mattress and/or the bed or some other supporting structure. The elements 2 are interconnected successively in a band-like fashion. Thus the mattress can advantageously be manufactured as a uniform band of two overlapping material webs 3, 4, which are connected together in a ladder-like fashion at the seam joints 5, 6. The intervals of the transversal seam joints 6, including one or several seams, form the elements 2 of the mattress. The obtained band is cut into basic sections of suitable lengths, which are for instance 4–6 meters each. The length of the basic section depends, except for the length of the bed, also on how many elements are desired to be included in the bed.

Figure 2A:
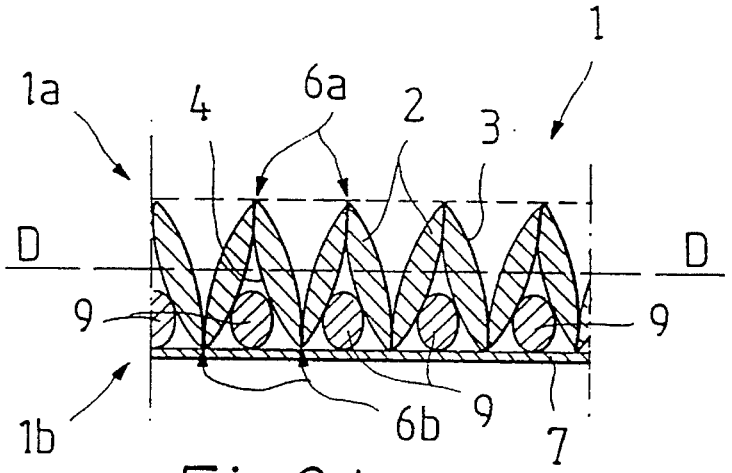
FIG. 2A is a cross-sectional illustration of a mattress of the present invention.
Figure 2B:
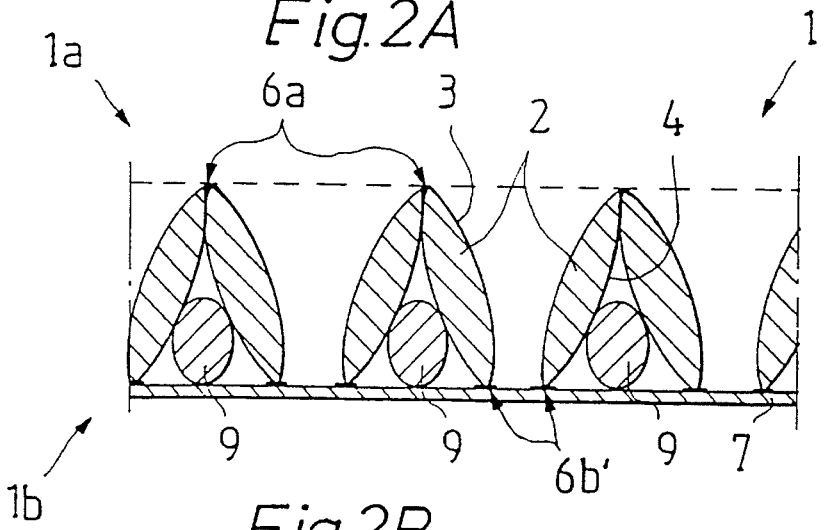
FIG. 2B is a cross-sectional illustration of another mattress of the invention.
Figure 3A:
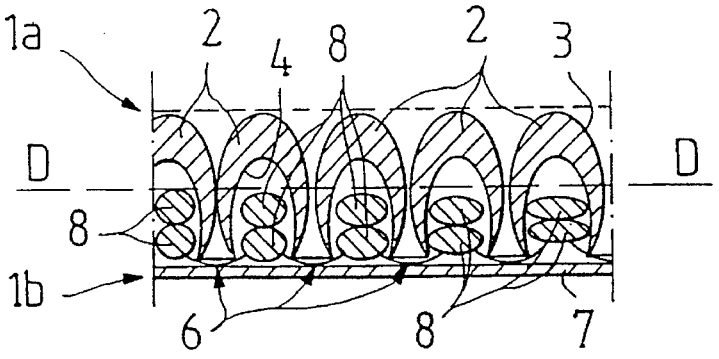
FIG. 3A is a cross-sectional illustration of a third mattress of the invention.

The successive elements 2 are arranged so that lengthwise seam joints 6; 6*b* (com. FIGS. 2A and 3A) of the elements are located at given intervals in the bottom part 1*b* of the mattress, and that the areas between these seam joints are arranged to form structures which are directed upwards from the bottom part 1*b* of the mattress. In fact the structure between the lengthwise seam joints 6; 6*b*; 6*b*'; 6' of the elements are bent upward loop-like in cross-section as it can be understood from the FIGS. 2A, 2B, 3A and 3B of the preferred embodiments. This upward bent vaulted or arched structure has an upside-down V-form in the embodiments of the invention in FIGS. 2A and 2B and an upside-down U-form in the embodiments of the invention in FIGS. 3A and 3B (and FIGS. 9A, 11–15).

The successive elements 2, for example in the basic section mentioned above, are in FIGS. 2A and 2B folded against each other in pairs so that every second longitudinal seam joint 6*a* is located in the top part 1*a* of the mattress, and every second seam joint 6*b*; 6*b*' is located in the bottom part 1*b* of the mattress 1.

Figure 3B:
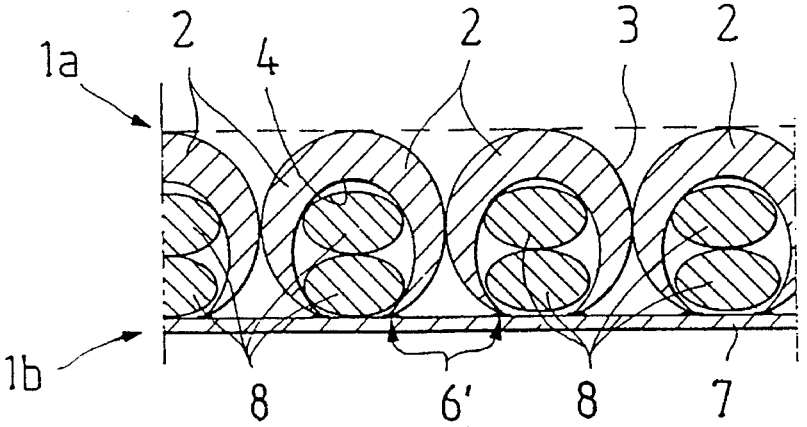
FIG. 3B is a cross-sectional illustration of a fourth mattress of the invention.

Alternatively the successive elements 2 are in FIGS. 3A and 3B bent to an upside-down U-form so that the longitudinal seam joints 6; 6' of the elements are always located in the bottom part 1*b* of the mattress. In that case the elements 2 rise like loops or vaulting up from the bottom.

In the first preferred embodiment of the invention, the basic section of the mattress 1 received from production is folded in the lengthwise direction to form a bed-long mattress with an accordion-like structure (FIG. 2A), which is then placed for instance in a bed frame. At the seam joints 6*b* the elements are mechanically attached to each other at the sides only.

In a preferred embodiment of the invention the elements 2 of the mattress are connected to an underlay 7. The fixing Joints 6*b* at the bottom part of the mattress are then also fixing joints where the elements are fixed to the underlay 7.

The basic section of the mattress produced in the manufacturing process can also be compiled to form the mattress proper, so that in the lengthwise direction D—D of the mattress, the elements 2 form loop-like parts protruding upwards from the underlay 7, i.e. successive elements are bent to an upside-down U-form, as was described above (FIG. 3A). Now the fixing joints 6, which are advantageously relatively broad, are attached adjacently to the underlay 7 from the fixing joints so that the elements 2 rise like an arch from the underlay 7.

The seam joints between the successive elements 2 are advantageously relatively broad. Alternatively there can be two seam joints close to each other instead of one broad seam joint and between these seam joints is a fixing joint. The elements 2 are connected to an underlay 7 at the border lines of the seam joint 6 or at said two seam joints 6*b*'; 6' which serve also as the fixing joints 3. The two superimposed webs 2, 3 between said border lines of the seam joints or said two seam joins can be cut away as it is presented in FIGS. 2B and 3B. Then the mattress elements 2 are separate and independent elements. In other respects a mattress is of the same form as described above in connection with FIGS. 2A and 3A.

The separating of the elements 2 as described above makes it easier to put together and produce a mattress according to the invention. Further, we can use appropriate number of separate elements 2 in a mattress of the invention and also change said number quite easily if necessary.

The underlay 7 is a flexible fixing base for the mattress elements 2, which base is preferably a thin sheet or the like. The underlay 7 is made of material such as plastic, fabric or their combination. Alternatively the underlay 7 comprises strips, ribbons or the like, which are spaced apart in the bottom part of the mattress.

Beneath the first elements 2 of the mattress, there is advantageously arranged some additional padding in order to prevent bottom contact. This padding can be for instance a uniform padding carpet. Advantageously the padding is realized so that beneath the arched structure of the successive elements 2, and in between the seam joints 6*b*; 6; 6*b*'; 6' and/or the seam joints located in the bottom part 1*b* of the mattress 1, there is placed one or several elongate second mattress elements 8 such as paddings (FIG. 3), which can be successively interconnected in order to facilitate their production. The second elements can be bag-like elements 9 (FIG. 2), which are also inflatable with fluid, preferably air or with some other gas. On the other hand, these elongate second elements can as such be made of some solid but resilient material or filled with the same. Preferably these second mattress elements have a cylindrical form.

Figure 4:
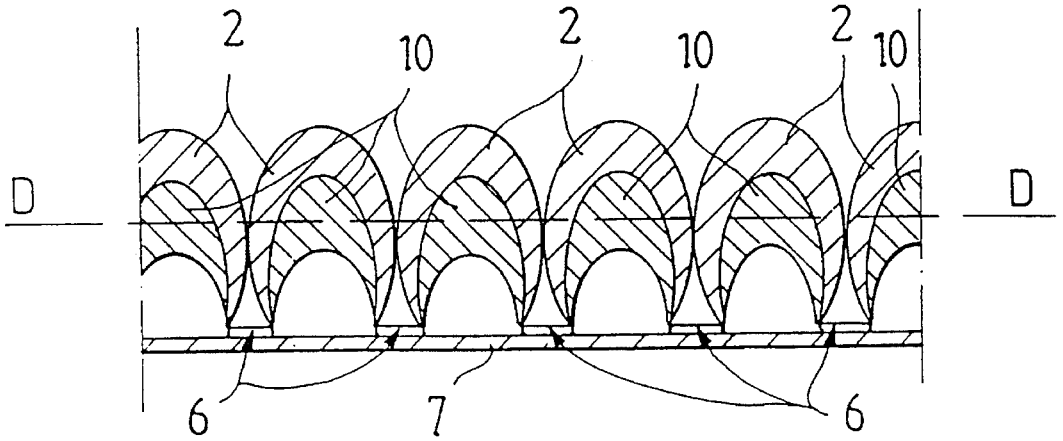
FIG. 4 is a cross-sectional illustration of a fifth mattress of the invention.

The mattress of the invention can also be realized so that underneath the first successive elements 2 there is arranged a second set of corresponding successive elements 10, which first and second elements are advantageously connected to each other as is apparent from FIG. 4. This kind of air mattress can be manufactured according to the same principle as the one illustrated in FIG. 1. In the manufacturing process, there is needed only a third material web to be placed on top of the first two, which third web is connected to the rest at the seam joints 5, 6 in a ladder-like fashion.

Figure 5:
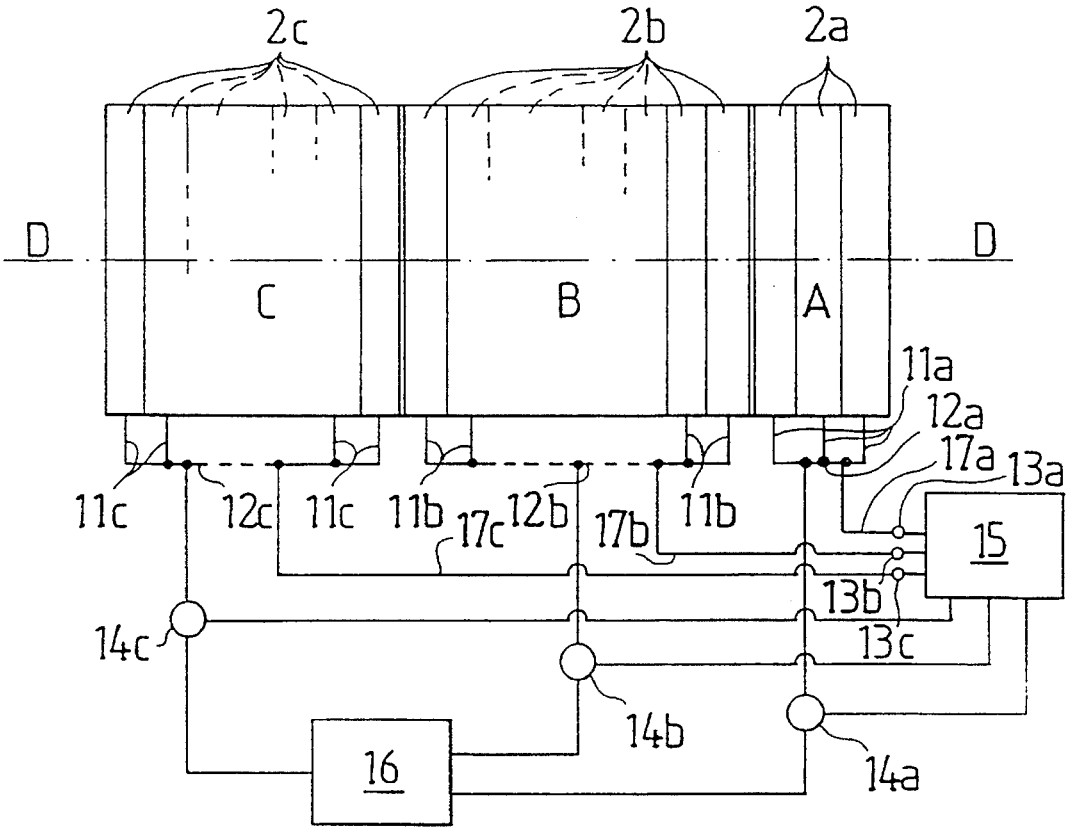
FIG. 5 is a schematical illustration of a mattress of the invention, the mattress being divided into element groups, as well as of the adjusting device and the gas supply source thereof.

The elements 2 of the mattress 1 are advantageously divided at least into three different groups A, B and C in the direction D—D of the lengthwise axis of the mattress, as is illustrated in FIG. 5. The elements of the mattress are divided into groups for instance so that one of the said groups, for example A, is located under the head of the person lying on the mattress, the second for example B is located under the middle part of the body, and the third group, for example C, is located under the legs. The elements 2*a*, 2*b*, 2*c* of each group are connected to each other and/or to a connecting duct 12*a*, 12*b*, 12*c* by means of inlet conduits 11*a*, 11*b*, 11*c* such as flexible tubes, and further, via controllable valves 14*a*, 14*b*, 14*c* and a suitable adjusting device 15, whereto the said valves are connected, to the gas supply 16 or the like, such as an air pump, which also is advantageously under the control of the adjusting device 15. By means of the auxiliary conduits 17*a*, 17*b*, 17*c*, the gas pressures prevailing in the various groups are registered in the pressure sensors 13*a*, 13*b*, 13*c*, which are connected to the adjusting unit 15. Alternatively the pressure sensors 13*a*, 13*b*, 13*c* can also be installed in the connecting ducts 12*a*, 12*b*, 12*c*. The gas pressure of the elements 2*a*, 2*b*, 2*c* of each group A, B, C can thus be measured, adjusted to be suitable and maintained on the desired level particularly when the mattress 1 is being used.

In principle either set of elements 2; 9, 10, which are in this case air-inflatable and located either in the arched structure of the mattress or beneath said arched structure, can be divided into the said groups. In that case the air pressure in either set of elements is set to be constant, whereas the air pressure in the other set is adjustable. Moreover, the gas pressure in the separate elements can be adjusted to be suitable and maintained on this level when the mattress is in use.

Figure 6:
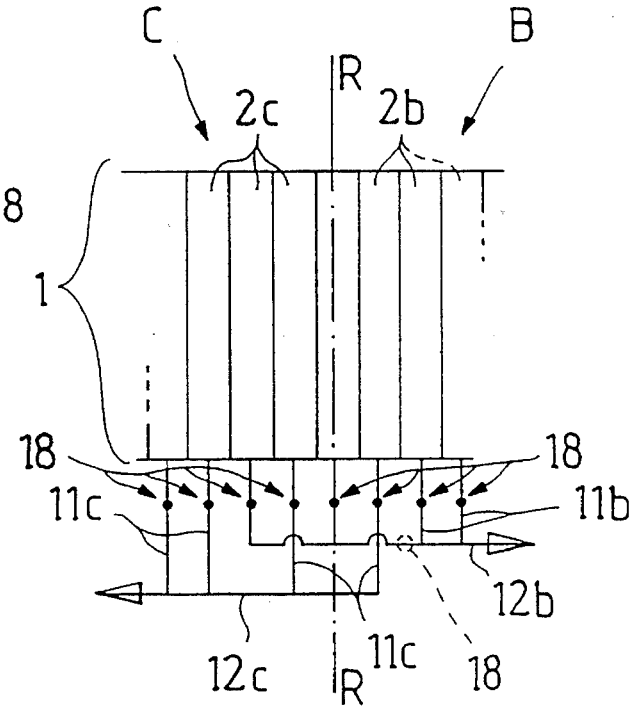
FIG. 6 is a top-view illustration of a section of a mattress of the invention.

In the border areas between the groups A, B and C, the elements of separate groups, such as 2*b* and 2*c* in FIG. 6, can be in turns divided to different groups, for instance into both of the said groups B and C. Thus the groups are interlaced near the boundary surface R to be partly overlapping, so that for instance every second element 2*c* belongs to the group C under the legs, and every second element 2*b* belongs to the group B under the body. This procedure is advantageously followed only as regards one or two elements placed in the vicinity of the illusory boundary surface R. The advantage of this arrangement is that the person lying on the bed does not feel any clear division of the elements into different groups.

The elements 2*a*, 2*b*, 2*c* of the mattress 1 are connected, via the inlet conduits 11*a*, 11*b*, 11*c*, in groups A, B, C to the connecting ducts 12*a*, 12*b*, 12*c* and to each other, and further to the gas supply 16 such as an air pump or tank or the like, as is illustrated in FIG. 5. The conduits 11 or 12 can be provided with cut-off valves 18, as is apparent from FIG. 6. Each valve functions so that it closes the conduit, such as the inlet conduit 11, when the gas flow surpasses the predetermined limit. Among the advantages of this arrangement let us point out that when the body weight is suddenly shifted, for instance when sitting up in the bed, on top of only a couple of the elements 2 of the mattress, these are not completely flattened our but maintain their supporting effect because the valves 18 prevent the elements from being suddenly exhausted. It is not absolutely necessary to provide the said cut-off valves 18 in connection with all elements 2 of the mattress. They can be installed for instance in the elements located in the middle area B of the mattress, or in connection with at least one or two such elements that are likely to be placed under the buttocks of the person lying on the bed. The group B can also be divided into two subgroups of elements, in between which the cut-off valve 18 is installed.

Figure 7:
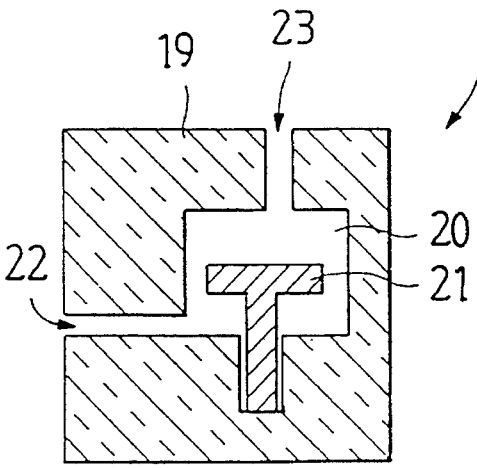
FIG. 7 is an illustration of a valve to be used in connection with the mattress of the invention.

The said cut-off valve 18 is advantageously of the following type illustrated in FIG. 7, but some other type of suitable valve can also be employed. The cut-off valve 18 comprises a housing 19, a chamber 20, which is located inside the housing 19, and a bobber 21 placed in the chamber 20. The cross-section surface of the bobber 21 is smaller than the respective surface of the chamber. A gas inlet channel 22 is connected to the first end of the chamber, and a gas outlet channel 24 is connected to the second end of the chamber. The bobber 21 is placed in the chamber in between the said inlet and outlet channels 22, 23. The bobber 21 remains at least roughly in place in the chamber 20 when the gas flow is smaller than the predetermined value, but when the gas flow surpasses the predetermined value the bobber is shifted, along with the flow, and closes the outlet channel 23. The cut-off valve 18 advantageously allows the gas to flow in the opposite direction, from the outlet channel into the inlet channel, irrespective of the flow speed. If necessary, the valve can be adjusted, for instance by changing the weight of the bobber or the said surface areas, or by means of suitable spring arrangements.

Figure 8:
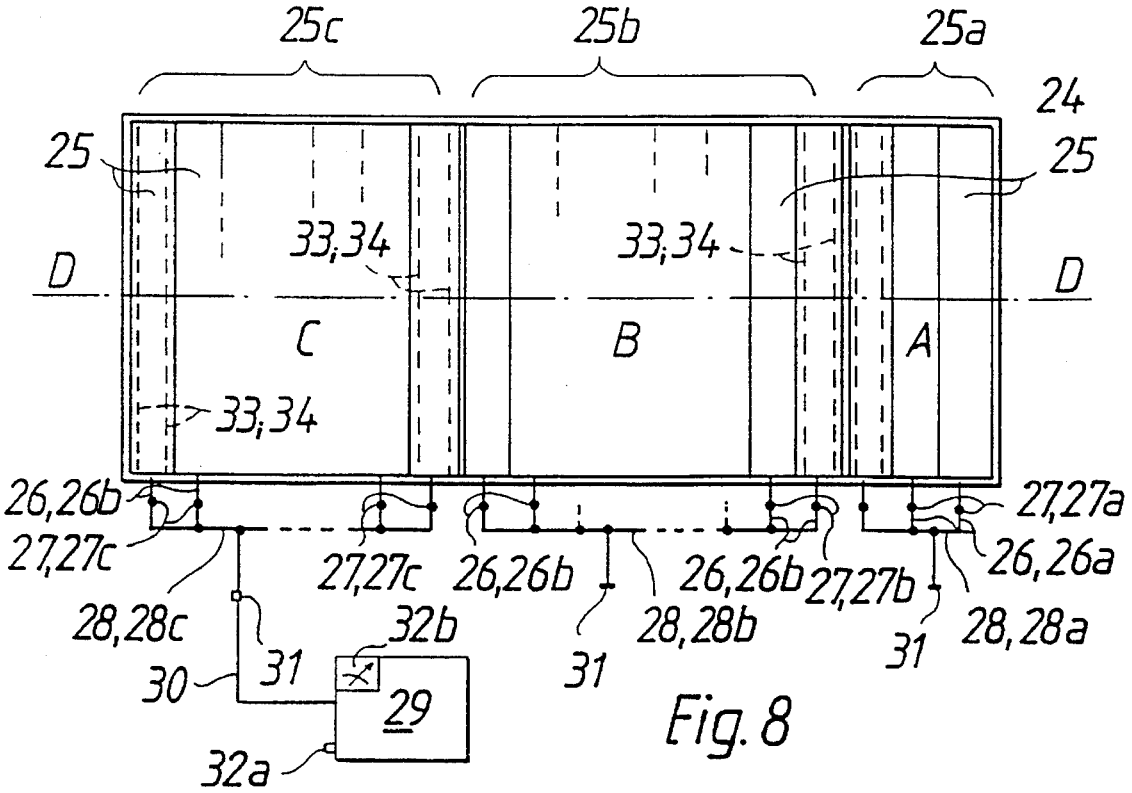
FIG. 8 is a schematical illustration of a sixth mattress of the invention, seen from the top.
Figure 9A:
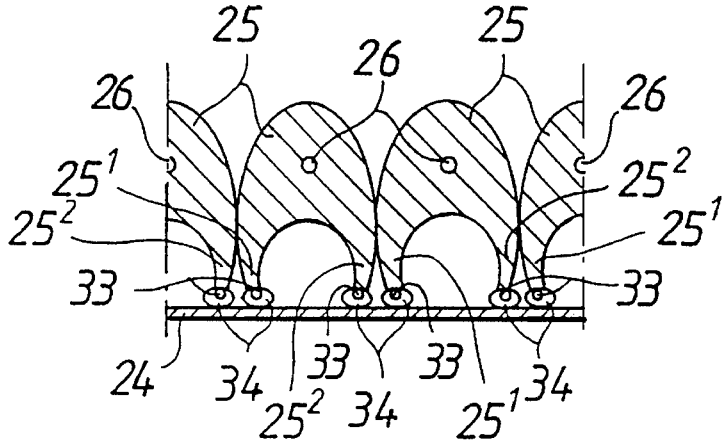
FIG. 9A is a partial illustration of the mattress of FIG. 8, seen from the side.

A sixth embodiment of the mattress of the invention is represented in FIGS. 8 and 9A. The mattress comprises a bottom part 24 and a number of elongate, bag-like mattress elements 25. The bottom part 24 is a rectangular, plate-like and flexible piece. It corresponds to the bottom part 7 of previous embodiments. The mattress elements 25 correspond to the elements 2 of previous mattresses. The mattress elements 25 are formed of for instance one or several plastic material layers. The mattress elements 25 can be inflated with gas, advantageously air, to a suitable pressure. They are attached adjacently to the bottom part 24 of the mattress, and transversally to the longitudinal direction D—D of the mattress. The mattress elements 25 form protruding members, in cross-section resembling an upturned U-shape or the like, which are thrust upwards from the bottom part 24, as is illustrated in FIG. 9A.

In the embodiment of FIG. 8, the mattress elements 25 of the mattress are divided, in the direction of the longitudinal axis D—D of the mattress, into three groups A, B and C, exactly as in the embodiment of FIG. 5. The first group A is meant to be under the head of the person lying on the mattress, the second group B under the middle part of the body, and the third C under the legs. The mattress elements 25*a*, 25*b*, 25*c* belonging to each group A, B, C are connected, via the channels 26; 26*a*, 26*b*, 26*c* and valves 27; 27*a*, 27*b*, 27*c* fitted therein, to the connecting duct 28; 28*a*, 28*b*, 28*c* of each group. The mattress element groups 25*a*, 25*b*, 25*c* are connectable, via the connecting duct 28; 28*a*, 28*b*, 28*c* further to the air pump 29 or to a suitable gas supply by means of the supply channel 30 and suitable connecting pieces 31. In connection with the air pump 29, there is arranged an discharge valve 32*a* and a pressure gauge 32*b*. By means of the air pump 29 and by utilizing the discharge valve the mattress element groups 25*a*, 25*b*, 25*c* can be inflated in turns, first to basic pressure and then to the final desired air pressure when the patient is lying on the mattress. This arrangement can also be employed in the embodiment of FIG. 5.

Figure 9B:
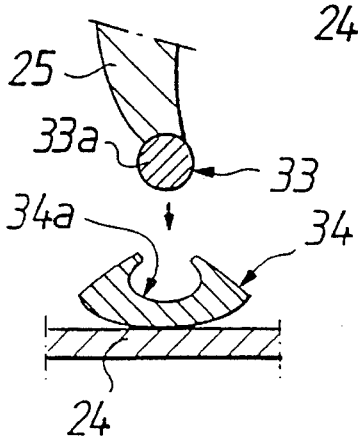
FIG. 9B is an enlarged cross-sectional illustration of the fastening members of FIG. 8, as detached from each other.

The mattress elements 25 of the mattress are attached to the bottom part 24 by means of fastening members. These fastening members are formed of matching first and second fastening members 33, 34, as is seen in FIGS. 9A and 9B. The first fastening member 33 is arranged on two longitudinal sides $\mathbf{25}_1$, $\mathbf{25}_2$ of a U-shaped or similar mattress element 25, as a uniform fastening member extending along the whole length of the element (dotted lines in FIG. 8). Respectively, second fastening members 34 are fastened at regular intervals to the bottom part 24 of the mattress, so that the two first fastening members 33 of the mattress element 25 can respectively be attached to the bottom part 24, to adjacent second fastening members 34 spaced apart.

Advantageously the first fastening member 33 is a male member, and the second fastening member 34 is a female member. An alternative way to realize the fastening members is that the first fastening member is a female member and the second is a male member. Then the fastening members can be easily attached to each other and respectively the fastening members are easily detachable.

The male fastening member 33 is formed of an elongate, flexible bracket 33*a*, which is essentially a circle segment in shape. The female fastening member 34 is formed of an elongate flexible counterpart provided with a slot 34*a*, as is illustrated in FIG. 9B. The width of the slot aperture 34*a* is smaller than the diameter of the bracket 33*a*. The bracket 33*a* of the male fastening member 33 can be pressed into the slot 34*a* of the female member 34 while fastening the mattress element 25 to the bottom element 24, and respectively the fastening members 33, 34 are easily detachable simply by pulling apart.

Figure 10:
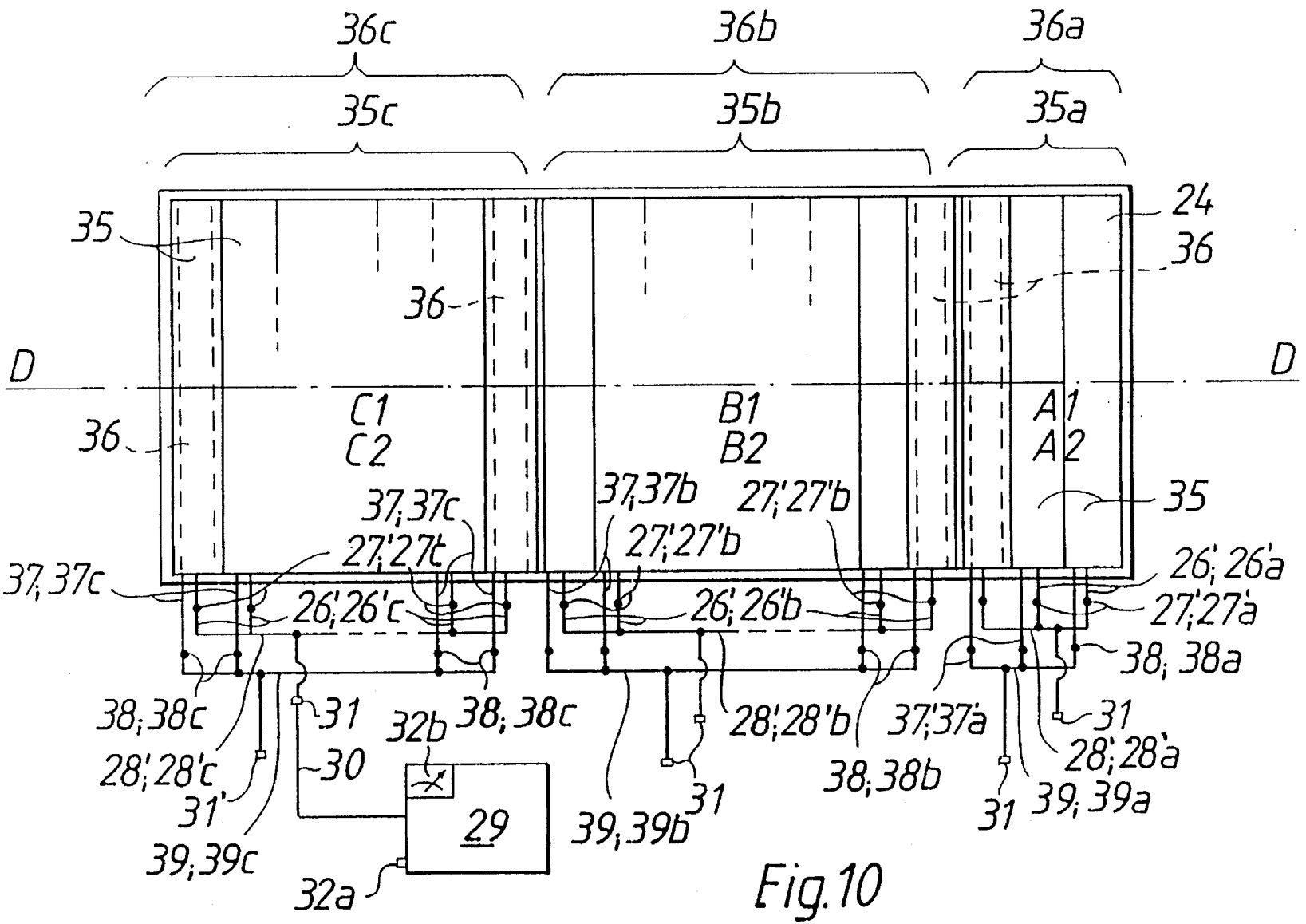
FIG. 10 is a schematical illustration of a seventh mattress of the invention, seen from the top.
Figure 11:
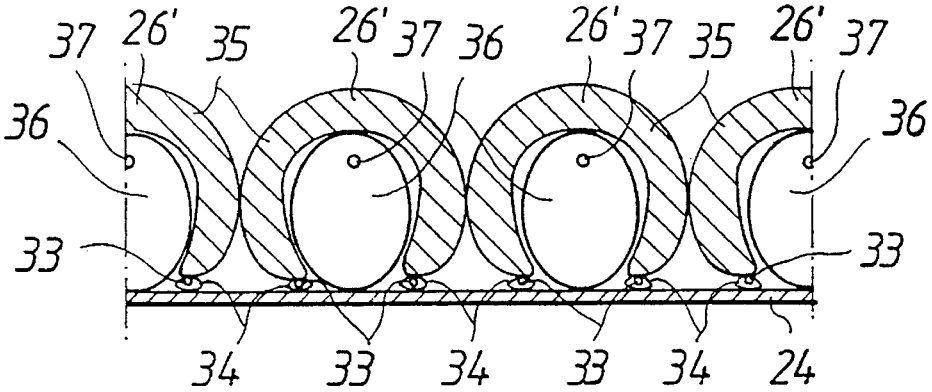
FIG. 11 is a partial illustration of the mattress of FIG. 10, seen from the side.
Figure 12:
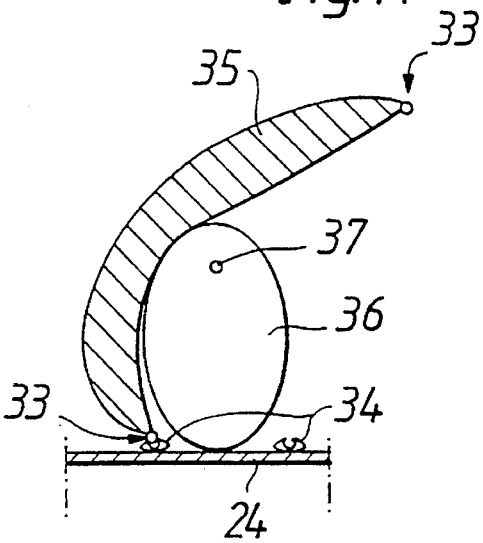
FIG. 12 illustrates a mattress element of the mattress of FIG. 10, seen from the side.

A seventh mattress of the invention, particularly an air mattress, is illustrated in FIGS. 10, 11 and 12. This mattress comprises a bottom part 24, a number of first bag-like mattress elements 35 and a number of second bag-like mattress elements 36. The bottom part 24 and the first mattress element 35 correspond to the bottom part 24 and mattress elements 25 illustrated in FIGS. 8 and 9A respectively. In this case the bottom parts 24 are similar, and the same reference number is used of both. The second elongate bag-like mattress elements 36 are inflatable with gas, such as air, or alternatively they are elements made of some solid, resilient material or filled with such material. In this embodiment, the second mattress element 36 is formed of an air-inflatable member. Encompassing each second mattress element 36, at least partly, there is provided the first mattress element 35, as can be understood for instance from FIG. 11.

Seen from above, FIG. 10, the mattress formed of the mattress elements 35, 36 looks the same as the mattress formed of mattress elements 25 in FIG. 8. The first and second mattress elements 35, 36 can be divided into three groups in similar fashion as the above mentioned mattress elements 25.

The first mattress elements 35 are thus divided into three groups A1, B1, C1, including the mattress elements 35*a*, 35*b*, 35*c* respectively. The elements 35; 35*a*, 35*b*, 35*c* belonging to each group A1, B1, C1 are connected via the channels 26'; 26'*a*, 26'*b*, 26'*c* and via valves 27'; 27'*a*, 27'*b*, 27'*c* fitted therein to the connecting duct 28'; 28'*a*, 28'*b*, 28'*c* of each group. The mattress element groups 35*a*, 35*b*, 35*c* are connectable, through the connecting ducts 28'; 28'*a*, 28'*b*, 28'*c*, further to an air pump 29 or respective gas supply via a supply channel 30 and suitable connecting pieces 31, as was described above in connection with FIG. 8.

The second set of mattress elements 36 is divided into three groups A2, B2, C2, including the mattress elements 36*a*, 36*b*, 36*c* respectively. The mattress elements 36; 36*a*, 36*b*, 36*c* are connected via the channels 37; 37*a*, 37*b*, 37*c* and via valves 38; 38*a*, 38*b*, 38*c* fitted therein to the connecting duct 39; 39*a*, 39*b*, 39*c*, which is further connectable to an air pump 29 via a supply channel 30 and suitable connecting pieces 31'. By using the air pump 29, the second mattress elements 36; 36*a*, 36*b*, 36*c* of each group A2, B2, C2 can be inflated to suitable basic pressure while the mattress is in use. The adjusting proper of the mattress can be realized by adjusting the pressures of the first mattress elements 35; 35*a*, 35*b*, 35*c*.

The first mattress elements 35 can be left outside the above mentioned groups A1, B1, C1, in which case they are compiled of single mattress elements 35, or alternatively of small groups of two or three elements, so that the gas pressure of each mattress element can be measured and adjusted separately or in small groups, for instance by means of the air pump 29, the discharge valve 32*a* and the pressure gauge 32*b*, as was described above. This adjusting method is advantageous, because certain parts of the body (for example bony, protrusive points such as the heel, sacrum, shoulder blades and the back of the head) are particularly susceptible to the creation of bedsores. It is also possible that the patient already has bedsores, as results of previous unfavourable circumstances, in other parts of the body, too. Now the surface pressure directed to the critical points can be minimized by lowering the gas pressure in the mattress element 35 located at the critical spot, for instance at the heel, and respectively the gas pressure in the adjacent mattress elements is raised.

Each first mattress element 35 includes, arranged in the longitudinal direction thereof, first fastening members 33, such as male members, and respective second fastening members 34 of the bottom part 24, such as female members, as it can be understood from FIGS. 10 and 11. These fastening members 33, 34 can be detachably fastened to each other, in which case the mattress elements 35 can be detached from the bottom part 24 and replaced in a similar fashion as in the embodiment of FIGS. 8 and 9A, 9B above.

In this embodiment, the first and second fastening members 33, 34 are advantageously similar as the fastening members 33, 34 in the mattress element 25 and the bottom part 24 of FIG. 9A, 9B, and like numbers are used for like parts.

FIG. 12 illustrates the detaching of one first mattress element 35 from the bottom part 24, and—when observed in the opposite order—its fastening to the bottom part 24. When for one reason or another one of the first mattress elements 35 is at least partly deflated and the pressure therein decreases, it can quickly be replaced while still using the mattress, and the replacing does not necessarily cause problems for the patient lying on it. The defective mattress element 35 is located in the mattress element group A1, B1, C1, in case the mattress is divided into such groups, and the valves 27' of other mattress elements 35*a*, 35*b*, 35*c* are closed (in case they are open). The first 33 and second 34 fastening member are detached from each other, whereafter the first mattress element 35 is removed from around the second mattress element 36. Thereafter a new, undamaged first mattress element 35 can be installed, by similarly attaching the first 33 and second 34 fastening member together, to both sides of the second mattress element 36. The first mattress element 35 is connected, via the channel 26' and valve 27' to the connecting duct 28' of the said mattress element group A1, B1, C1. The air pump 29 is connected, by means of the supply channel 30 and connecting pieces 31 to the connecting duct 28'. The mattress element 35 is inflated by the air pump 29 up to a suitable pressure, whereafter the valve 27' can be closed and the air pump 29 detached from the connecting pieces 31 off the corresponding mattress element group 35; 35*a*, 35*b*, 35*c*. Now the mattress is again in working order.

Figure 13:
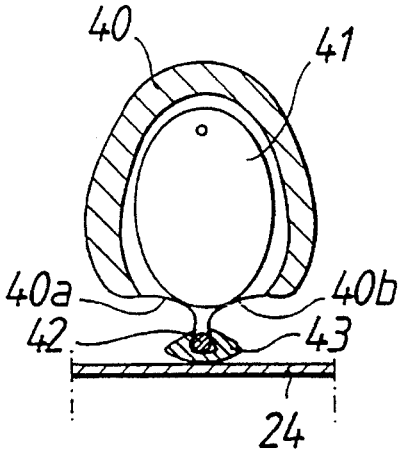
FIG. 13 illustrates a mattress element of the eighth mattress of the invention, seen from the side.

An eighth mattress of the invention is illustrated in FIG. 13. This mattress comprises a bottom part 24, a number of first elongate bag-like mattress elements 40 and respectively a number of second elongate bag-like mattress elements 41. In principle the first 40 and second 41 mattress elements are similar elements as were described above, in connection with FIGS. 10 and 11, for example. In this preferred embodiment, the first mattress element 40 has a tubular shape, wherein the long sides 40*a*, 40*b* of a U-shaped mattress element are interconnected, and at this junction or in the vicinity thereof, there is provided the first fastening member 42, i.e. a male member. In the bottom part 24 of the mattress, at regular intervals, there are arranged the second i.e. female fastening members 43. These fastening members 42, 43 are in principle similar as the fastening members 33, 34 of the mattress element 25 and bottom element 24, described above in connection with FIG. 9B. Alternatively, the fastening members 42, 43 can be installed in an opposite fashion as was described above. Also in this case, the second mattress element 41 is air-inflatable and is fitted inside the first mattress element 40, as is apparent from FIG. 13.

In the embodiment of FIG. 13, both mattress elements 40, 41 are detached from the bottom part 24 simultaneously by unlocking the fastening members 42, 43; respectively, a new first 40 and second 41 mattress element can be fitted in place by rejoining the said fastening members 42, 43. This embodiment is a simple one; only one fastening member 42 is employed in connection with one mattress element 40. On the other hand, both the first 40 and second 41 mattress element must be removed from the mattress, even if only one of them is damaged.

The mattress element 40 of FIG. 13 can also be realized in the embodiments of the invention which are described above, for instance in the embodiments of FIGS. 2B and 3B. In these cases, the tubular first mattress element is permanently connected to the bottom part at the fixing joint.

Figure 14:
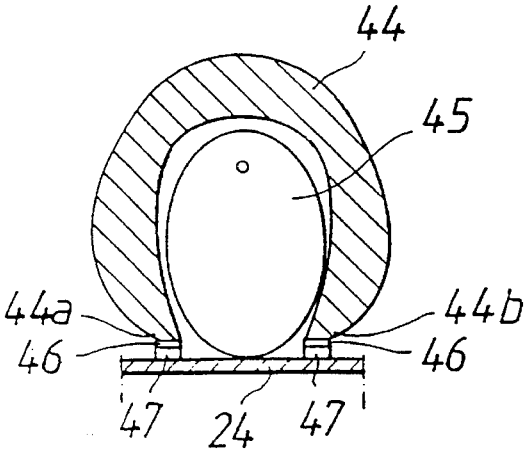
FIG. 14 illustrates a mattress element of the ninth mattress of the invention, seen from the side.

FIG. 14 illustrates one mattress element of a ninth mattress of the invention. The first element 44 and second element 45 of the mattress can be similar as was illustrated in connection with the previous embodiment (FIGS. 10 and 11). In this case, to both sides 44*a*, 44*b* of the first mattress element 44, there are attached first hook strip ribbons 46, in the longitudinal direction of the mattress element 44. In similar fashion, in connection with the bottom part 24 there are attached second hook strip ribbons 47, spaced apart. The hook strip ribbons 46, 47 are advantageously identical and grip together at their tiny hook-like or loop-like notches. The hook strip ribbon is for instance Velcro (TM) tape or some other commercially available strip ribbon.

Figure 15:
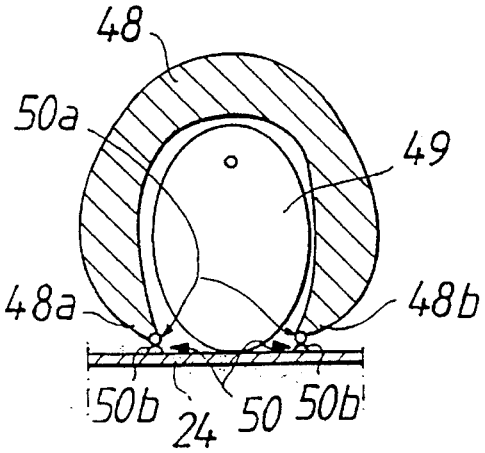
FIG. 15 illustrates a mattress element of the tenth mattress of the invention, also seen from the side.

FIG. 15 illustrates a mattress element of a tenth mattress of the invention. The first 48 and second 49 element of the mattress can be similar as was illustrated in connection with the previous embodiment (FIGS. 10 and 11). In this case, to both long sides 48*a*, 48*b* of the first mattress element 48, there are attached the first halves 50*a* of the zipper 50, whereas the second halves 50*b* of the zipper 50 are respectively attached to the bottom part 24 of the mattress, at regular intervals. When the zipper 50 is pulled open, the first mattress element 48 can be detached from the bottom part 47, and respectively replaced by another similar first mattress element provided with the half 50*a* of the zipper 50. In the embodiments of FIGS. 14 and 15, the first mattress element 44; 48 is fitted to encompass the second mattress element 45; 49 as an open loop or an arched structure, exactly as in the embodiments of FIGS. 10–13. It is apparent that the first mattress element can be closed to form a tubular member, as in the embodiment of FIG. 13, and that in the middle of this tubular member, there can be fitted another mattress element in similar fashion. Now in connection with the first mattress element, one first fastening member can be employed, for instance a hook strip ribbon 47 or the first half 50*a* of a zipper 50. The bottom part 24 of the mattress can in principle be realized similarly as above, and as is readily understood from FIG. 13. Thus the bottom part 24 comprises a second set of fastening members located at regular intervals, which members respectively are hook strip ribbons or second halves of zippers. It is pointed out that in the above described preferred embodiments of the mattress of the invention, the fastening members are simple and easily fixable both to the mattress elements and to the bottom part. The advantage is that the mattress is simple in structure and economical in production costs.

In the above specification, the invention has been described with reference to several embodiments thereof. It is naturally clear that the invention can be modified in many ways by varying and compiling the ideas introduced in the preferred embodiments. Mattress elements can be divided into more groups than in the above description, and the mattress elements located on the boundary surfaces thereof can be divided to different groups in an alternating fashion, as is illustrated in FIG. 6.

The heights of the mattress elements 2; 25, 35, 36; 40, 41; 44, 45; 48, 49 of the invention, i.e. the thickness of the mattress, is advantageously within the range 10–20 cm, which corresponds to a normal mattress thickness. The width of the mattress and accordingly the width of the mattress elements, is chosen according to the specific needs and the measures of the bed. The bed in itself can be any type of normal bed or for instance a hospital bed, whereto an ordinary spring mattress can be placed. The material of which the mattress, especially the mattress elements, is made is plastic, fabric or some other flexible and inextensible material which is impermeable to fluid such as gas or air.

The method of the invention for adjusting the pressure in the mattress is based on the idea that underneath the human body or part thereof, there is arranged a supporting fluid cushion such as gas or air cushion, the pressure p whereof is minimized, and the contact surface A with the body or part thereof is maximized. In order to make the fluid support the weight m of the body, the pressure p should apparently be $p=m/A$. Let us suppose that the surface area of the human body, from the neck down to the gluteal skinfold, is $A=50\times 70\ cm^2=3\ 500\ cm^2$, and the weight m of the upper part of the body=50 kg, then the pressure p required in the mattress for supporting the body is about 15 $g/cm^2$, i.e. 15 cm $H_2O$=15 mbar. If a person is laid down on a normal, conventional air mattress, the pressure whereof is the sum of the air pressure and the said pressure, the person sinks down onto the bottom of the mattress, i.e. the mattress is flattened out beneath the patient, and the parts of the mattress which remain outside the person are bulged. The patient is not lifted on top of the bedding before the mattress pressure is remarkably higher than the one calculated above. In the air mattress of the invention, its standard-volume elements reach the calculated pressure, whereafter they are pressed together and shaped so that the contact surface between the human body or parts thereof and the mattress is as large as possible. Each mattress element 2; 25 or each group A, B, C of the mattress is in the method of the invention only partly filled with fluid, advantageously with gas such as air, and so that the fluid pressure in each element corresponds to the pressure of the surroundings, i.e. p=1 bar when the weight load directed thereon is nonexistent. In that case each element is partly compressed. When the human body or part thereof is laid to rest on top of the mattress elements, the pressure p' in each elements grows, according to the weight load of the body or part thereof, after a known fashion $p'=p+m/A$, where p is the earlier pressure, m is the mass of the body or part thereof, and A is the contact surface between the body and the mattress element. Thus the supporting, resilient surface of each element conforms to all protruding parts and recesses of the body or part thereof, and simultaneously distributes the surface pressure against the body etc. evenly over the whole body or part thereof.

The fluid pressure in the mattress elements 2; 25; 35; 40; 44; 48 is most suitably set within the range of about 15–25 cm $H_2O$ when the mattress is being used, i.e. somebody is lying on it. The pressure is one element is dependent, among other things, on the location of the said element with respect to the body: under the back and the buttocks, the pressure is naturally higher than under the head and the legs.

If the mattress is formed of the first 2; 25; 35; 40; 44; 48 and the second elements 9; 10; 36; 41; 45; 49, which are placed in connection with each other in the mattress as explaned above, and which elements are both inflatable with fluid preferably gas such as air, the pressure can be set in either set of the elements, for instance in the first set 2; 35; 40; 44; 48, to a suitable constant value. The pressure of the second set of elements 9; 10; 36; 41; 45; 49 is adjusted according to the above described method. Alternatively the pressures of the elements 2; 35; 40; 44; 48 and 9; 10; 36; 41; 45; 49 can be set in the opposite fashion.

The method of the invention is advantageously provided with a method for controlling critical low and high pressures in cases where the mattress is used as a high-class nursing mattress in a hospital or other such institution. Then the mattress is formed to be relatively thick, for instance 15–20 cm, and it allows the use of particularly low fluid pressures. The control system is operated so that when the pressure falls below the critical limit either in the mattress, in the elements 2; 25; 35; 40; 44; 48 thereof of in one of the groups A, B or C; A1, B1 or C1, more fluid is let or inflated into it. The fluid supply is cut off at the critical top limit, for instance when the pressure in the elements of group B has reached the critical limit 15–25 cm $H_2O$. The mattress is also advantageously provided with zero-pressure control: when the pressure falls for instance below 10 cm $H_2O$, the fluid supply is stopped, because it is probable that the mattress is not in normal use. Otherwise the mattress would bulge to excessive pressure when the patient leaves the bed.

In the above described situations the patient "floats" deep in the mattress. For various tasks required in the care of the patient, such as washing, bed-making and cleaning, the mattress can be over-filled and the patient thus be lifted up on top.

In the above description the invention has been described particularly as an air mattress, but the invention can obviously be applied to other corresponding supports, such as seat cushions, which are provided with padding. In the above specification it was also mentioned that the elements of the mattress or the like can be inflated with air or with some other gas. Instead of air or gas, the use of some other flowing fluid medium, such as water, can be applied.

What is claimed is:

1. A mattress, comprising:

a bottom part;

a plurality of elongate, bag-like first mattress elements, each said first mattress element enclosing a first fluid chamber for a flowing medium, said first elements being essentially parallel to each other and transverse to the longitudinal axis of said mattress, and said first elements being fixed to said bottom part at least at one fixing joint essentially parallel to the longitudinal direction of the mattress element, two mattress elements at the most constitute an arched structure, which is directed upward from the bottom part and is transverse to the longitudinal direction of the mattress, the fluid chambers of the mattress elements being inflatable with a flowing medium up to a suitable pressure while using the mattress; and wherein the first mattress elements are divided, in the direction of the longitudinal axis of the mattress, into at least three groups, the elements of each of these groups being connectable, via conduits, to a fluid supply, so that the fluid pressure in the elements of each group can be adjusted to be suitable when the mattress is being used.

2. A mattress according to claim 1, wherein each first mattress element is fixed to the bottom part of the mattress at two fixing joints essentially parallel to the longitudinal direction of the mattress, the fixing joints being located at the lengthwise sides of the mattress element, the distance of said fixing joints being smaller than the width of the first mattress element, so that the mattress element is formed as an arched structure, resembling for example an upturned U-shape, which is directed upward from the mattress bottom and is transverse to the longitudinal direction of the mattress.

3. A mattress according to claim 1, wherein each first mattress element is fixed to the bottom part of the mattress at one fixing joint essentially parallel to the longitudinal direction of the mattress, said fixing joint being located at the lengthwise sides of the mattress, so that the mattress element is formed as an arched structure where the lengthwise sides of the mattress are interconnected, and which element is directed upward from the mattress bottom and is transverse to the longitudinal direction of the mattress.

4. A mattress according to claim 1, wherein two adjacent first mattress elements are fixed to each other at the first lengthwise sides of the mattress elements and to the bottom part of the mattress at two fixing joints essentially parallel to the longitudinal direction of the mattress elements and located at the second sides of thereof, the mutual distance of said fixing joints being smaller than the width of two first mattress elements, so that two mattress elements constitute an arched structure which is directed upward from the mattress bottom and is transverse to the longitudinal direction of the mattress.

5. A mattress according to claim 1, wherein each first fixing joint of the mattress element is provided with at least one first fastening member arranged in the longitudinal direction of the element, and the fixing joint of the bottom part is provided with a matching second fastening member, which fastening members can be detachably fixed to each other, so that each mattress element is an element which can be detached from the bottom part and replaced.

6. A mattress according to claim 5, wherein said fastening members are formed of matching male and female fastening members.

7. A mattress according to claim 6, wherein the male fastening member comprises an elongate bracket, essentially having the shape of a circle segment in cross-section, and the female fastening member comprises an elongate counterpart provided with a slot, the slot aperture being smaller than the diameter of the bracket.

8. A mattress according to claim 6, wherein the fastening members are formed of elongate hook ribbon strips.

9. A mattress according to claim 6, wherein the fastening members are formed of opposite parts of a zipper.

10. A mattress according to claim 1, wherein the first mattress elements are interconnected at the longitudinal junctures thereof, which junctures constitute the seam joints between the mattress elements.

11. A mattress according to claim 10, wherein the first and second mattress elements are interconnected at their longitudinal junctures, which junctures constitute the seam joints between the mattress elements.

12. A mattress according to claim 1, wherein in the boundary areas between the separate groups, the elements of these groups are divided into different groups in an alternating fashion.

13. A mattress according to claim 1, comprising an adjusting device, pressure gauges and adjustable valves, whereby the fluid pressure in the mattress elements of each group can be adjusted and maintained to be suitable while the mattress is being used.

14. A mattress, comprising:

a bottom part;

a plurality of elongate, bag-like first mattress elements, each said first mattress element enclosing a first fluid chamber for a flowing medium, said first elements being essentially parallel to each other and transverse to the longitudinal axis of said mattress, and said first elements being fixed to said bottom part at least at one fixing joint essentially parallel to the longitudinal direction of the mattress element, two mattress elements at the most constitute an arched structure, which is directed upward from the bottom part and is transverse to the longitudinal direction of the mattress, the fluid chambers of the mattress elements being inflatable with a flowing medium up to a suitable pressure while using the mattress;

wherein the bottom part is essentially a rectangular, plate-like and flexible piece; and wherein the bottom part is formed of adjacent ribbon-like members spaced apart.

15. A mattress according to claim 14, wherein the bottom part is formed of at least one uniform plate, such as plastic film, fabric or other such material.

16. A mattress according to claim 14, comprising a number of elongate and flexible second mattress elements, which are fitted in connection with the first mattress elements, so that outside the first mattress elements, they are at least partly encompassed by the arched structures.

17. A mattress according to claim 16, wherein each second elongate mattress element is provided with a second fluid chamber, which can be filled with some flowing medium.

18. A mattress according to claim 16, wherein the second elongate mattress elements are made of some solid, resilient material.

19. A mattress, comprising:

a bottom part;

a plurality of elongate, bag-like first mattress elements, each said first mattress element enclosing a first fluid chamber for a flowing medium, said first elements being essentially parallel to each other and transverse to the longitudinal axis of said mattress, and said first elements being fixed to said bottom part at least at one fixing joint essentially parallel to the longitudinal direction of the mattress element, two mattress elements at the most constitute an arched structure, which is directed upward from the bottom part and is transverse to the longitudinal direction of the mattress, the fluid chambers of the mattress elements being inflatable with a flowing medium up to a suitable pressure while using the mattress;

a number of elongate and flexible second mattress elements, which are fitted in connection with the first mattress elements, so that outside the first mattress elements, they are at least partly encompassed by the arched structures;

wherein each second elongate mattress element is provided with a second fluid chamber, which can be filled with some flowing medium; and wherein the second mattress elements are divided, in the direction of the lengthwise axis of the mattress, into at least three groups, the elements of each of these groups being connectable, via conduits, to a fluid supply, so that the fluid pressure in the elements of each group can be adjusted to be suitable when the mattress is being used.

20. A mattress according to claim 19, wherein in the boundary areas between separate groups, the elements of these groups are divided into different groups in an alternating fashion.

21. A mattress according to claim 19, comprising an adjusting device, pressure gauges and adjustable valves, whereby the fluid pressure in the mattress elements of each group can be adjusted and maintained to be suitable while the mattress is being used.

22. A mattress, comprising:

a bottom part;

a plurality of elongate, bag-like first mattress elements, each said first mattress element enclosing a first fluid chamber for a flowing medium, said first elements being essentially parallel to each other and transverse to the longitudinal axis of said mattress, and said first elements being fixed to said bottom part at least at one fixing joint essentially parallel to the longitudinal direction of the mattress element, two mattress elements at the most constitute an arched structure, which is directed upward from the bottom part and is transverse to the longitudinal direction of the mattress, the fluid chambers of the mattress elements being inflatable with a flowing medium up to a suitable pressure while using the mattress; and wherein at least one of the elements of the mattress is connected via a conduit and a cut-off valve to at least one of the elements located nearby, said cut-off valve closing the conduit when the fluid flow in the conduit surpasses the predetermined value.

23. A method for adjusting a mattress which includes a bottom part; a plurality of elongate, bag-like first mattress elements, each said first mattress element enclosing a first fluid chamber for a flowing medium, said first elements being essentially parallel to each other and transverse to the longitudinal axis of said mattress, and said first elements being fixed to said bottom part at least at one fixing joint essentially parallel to the longitudinal direction of the mattress element, two mattress elements at the most constitute an arched structure, which is directed upward from the bottom part and is transverse to the longitudinal direction of the mattress, the fluid chambers of the mattress elements being inflatable with a flowing medium up to a suitable pressure while using the mattress, the method comprising the steps of:

(a) partially filling the first mattress elements with fluid, so that the fluid pressure corresponds to the pressure of the surroundings when the mattress elements are free of a weight load;

(b) laying a human body or part thereof on said mattress elements in a resting position;

(c) adjusting the fluid pressure in the first mattress elements to within the range of 15 to 25 cm $H_2O$; and (d) maintaining the fluid pressure of the elements within the range set in the first mattress elements.

24. A method according to claim 23, wherein, when the pressure in the first mattress elements starts sinking rapidly below 10 cm $H_2O$, the fluid supply into the mattress elements is cut off.

25. A method for adjusting a mattress which includes a bottom part; a plurality of elongate, bag-like first mattress elements, each said first mattress element enclosing a first fluid chamber for a flowing medium, said first elements being essentially parallel to each other and transverse to the longitudinal axis of said mattress, and said first elements being fixed to said bottom part at least at one fixing joint essentially parallel to the longitudinal direction of the mattress element, two mattress elements at the most constitute an arched structure, which is directed upward from the bottom part and is transverse to the longitudinal direction of the mattress, the fluid chambers of the mattress elements being inflatable with a flowing medium up to a suitable pressure while using the mattress, a number of elongate and flexible second mattress elements, which are fitted in connection with the first mattress elements, so that outside the first mattress elements, they are at least partly encompassed by the arched structures, wherein each second elongate mattress element is provided with a second fluid chamber, which can be filled with some flowing medium, the method comprising the steps of:

(a) the fluid pressure of the first mattress elements setting at a standard value;

(b) the second mattress elements inflating partially with a flowing medium, so that the fluid pressure corresponds to that of the surroundings, when the mattress elements are free of a weight load;

(c) a human body or part thereof laying on said mattress elements in a resting position;

(d) the fluid pressure in the second mattress elements is adjusting to within the range of 15 to 25 cm $H_2O$; and (e) the fluid pressure in the first mattress elements maintaining at the preset standard value and the pressure in the second mattress elements is maintained within the range 15–25 cm $H_2O$ when the mattress is being used.

26. A method according to claim 25, wherein when the pressure in the mattress elements starts sinking rapidly below 10 cm $H_2O$ the fluid supply into the mattress elements is cut off.

* * * * *